US009656282B2

(12) United States Patent
Lehmann et al.

(10) Patent No.: US 9,656,282 B2
(45) Date of Patent: May 23, 2017

(54) FLUID FLOW NOZZLE

(71) Applicant: Fiskars Oyj Abp, Helsinki (FI)

(72) Inventors: Charles A. Lehmann, Metamora, IL (US); Chad James Mammen, Washington, IL (US)

(73) Assignee: Fiskars Oyj Abp, Helsinki (FI)

( * ) Notice: Subject to any disclaimer, the term of this patent is extended or adjusted under 35 U.S.C. 154(b) by 148 days.

(21) Appl. No.: 14/261,536

(22) Filed: Apr. 25, 2014

(65) Prior Publication Data

US 2014/0319246 A1 Oct. 30, 2014

Related U.S. Application Data

(60) Provisional application No. 61/816,596, filed on Apr. 26, 2013.

(51) Int. Cl.

| | |
|---|---|
| ***B05B 1/34*** | (2006.01) |
| ***B05B 1/16*** | (2006.01) |
| ***B05B 1/00*** | (2006.01) |
| ***B05B 15/00*** | (2006.01) |
| ***B05B 1/14*** | (2006.01) |

(52) U.S. Cl.

CPC ..... *B05B 1/34* (2013.01); *B05B 1/00* (2013.01); *B05B 1/14* (2013.01); *B05B 1/16* (2013.01); *B05B 1/3405* (2013.01); *B05B 15/008* (2013.01)

(58) Field of Classification Search

CPC .... B05B 1/34; B05B 1/14; B05B 1/16; B05B 1/3405; B05B 1/00; B05B 15/008

USPC .... 239/589, 462, 487, 489, 590, 590.5, 390, 239/394, 592, 594

See application file for complete search history.

(56) References Cited

U.S. PATENT DOCUMENTS

| | | | | |
|---|---|---|---|---|
| 550,336 | A | 11/1895 | Williams | |
| 2,054,964 | A | 9/1936 | Barker | |
| 3,486,700 | A | 12/1969 | Bristow | |
| 4,813,611 | A * | 3/1989 | Fontana | B05B 1/005 239/589 |
| 5,685,376 | A | 11/1997 | Tirronen et al. | |
| 6,508,415 | B2 | 1/2003 | Wang | |

(Continued)

FOREIGN PATENT DOCUMENTS

| | | | |
|---|---|---|---|
| CN | 2096420 | U | 2/1992 |
| CN | 1137760 | A | 12/1996 |

(Continued)

OTHER PUBLICATIONS

International Preliminary Report on Patentability, PCT/US2014/035455, Fiskars Oyj Abp, 8 pages (Oct. 27, 2015).

(Continued)

*Primary Examiner* — Steven J Ganey
(74) *Attorney, Agent, or Firm* — Foley & Lardner LLP

(57) ABSTRACT

A fluid flow nozzle is provided that comprises an elongated body having an inlet end and an outlet end, and defining a channel extending therethrough in which the channel includes an inlet channel and an outlet channel having an outlet diameter that is less than the inlet diameter. The channel further defining a tapered channel extending from the inlet channel to the outlet channel with a plurality of vanes or grooves circumferentially spaced around the tapered channel to increase flow velocity while reducing turbulence and divergence of the discharge stream.

19 Claims, 3 Drawing Sheets

(56) References Cited

U.S. PATENT DOCUMENTS

| | | | | |
|---|---|---|---|---|
| 6,726,130 | B2 * | 4/2004 | Jaubertie | B24C 5/04 239/589 |
| 7,516,908 | B1 * | 4/2009 | Sack | A62C 3/0207 239/590.5 |
| 8,544,765 | B1 * | 10/2013 | Cornell | B05B 1/34 239/590.5 |
| 2001/0038045 | A1 * | 11/2001 | Heaslip | B22D 41/50 239/590.5 |
| 2002/0170983 | A1 | 11/2002 | Wang | |
| 2004/0144867 | A1 | 7/2004 | Ferrazza et al. | |
| 2006/0273202 | A1 | 12/2006 | Su | |
| 2009/0050707 | A1 | 2/2009 | Williams | |

FOREIGN PATENT DOCUMENTS

| | | | |
|---|---|---|---|
| CN | 2799084 | Y | 7/2006 |
| DE | 19922820 | A1 | 12/2000 |
| EP | 1844847 | A1 | 10/2007 |
| EP | 1844847 | A1 | 10/2007 |
| KR | 20-0406436 | Y1 | 1/2006 |
| RU | 2311963 | C1 | 12/2007 |
| RU | 2435649 | C1 | 12/2011 |
| WO | WO-99/02271 | A1 | 1/1999 |

OTHER PUBLICATIONS

International Search Report and Written Opinion corresponding to PCT Application No. PCT/US2014/035455, mailed Aug. 27, 2014 (12 pages).

English-language machine translation of DE 19922820, Innovations GMBH AS [DE] (Dec. 7, 2000).

English-language machine translation of CN 2096420, Gu, Chengshi (Feb. 19, 1992).

English-language machine translation of CN 2799084, Wei (Jul. 26, 2006).

* cited by examiner

FLUID FLOW NOZZLE

REFERENCE TO RELATED APPLICATION AND PRIORITY CLAIM

This application is a utility filing of and claims priority to provisional application No. 61/816,596, filed on Apr. 26, 2013, the entire disclosure of which is incorporated herein.

BACKGROUND

The present disclosure relates to fluid flow nozzles, and particularly to nozzles for use in accelerating water flow.

Fluid flow devices such as hose or wand attachments are well-known. Many such attachments are provided to accelerate the fluid or water flow from the hose or wand for various tasks. The desirable flow velocity usually depends on the nature of the task, for instance lawn watering versus power washing. In the former case a wider lower velocity flow pattern is desirable while in the latter case a high velocity narrower flow pattern is preferred.

It is known from basic physics that the velocity of fluid flow through a nozzle increases as the inner diameter decreases. Thus, nozzles by necessity include an inlet having a larger inner diameter than the outlet. How this diameter change is accomplished varies among fluid flow devices. Some devices utilize a stepped down diameter outlet bore but this approach leads to significant fluid resistance and reduced flow volume. Consequently, most devices provide a tapered bore that tapers from the larger inlet diameter to the smaller outlet diameter. Other devices utilize a spherical bore from the larger inlet to the smaller outlet diameter.

One typical problem is that at higher flow velocities the fluid flow can be more turbulent or may tend to diverge. Both problems are counter to the straight powerful flow streams that are desired for power spraying tasks, such as power washing. Consequently, there is a need for a fluid flow nozzle that can achieve high flow velocities while reducing turbulence and divergence of the fluid stream.

SUMMARY OF THE DISCLOSURE

A fluid flow nozzle is provided that is configured to increase flow velocity while reducing turbulence and divergence of the discharge stream. In one aspect the nozzle includes a tapered channel from the inlet to the outlet with a plurality of vanes along a length of the tapered channel. The vanes help ensure linear flow to reduce divergence of the discharge stream. In another aspect, the vanes may be curved to impart a rotational momentum to the fluid flow. In yet another aspect, the vanes are replaced with grooves defined in the inner wall of the tapered channel. The grooves may also be curved to help impart a rotational momentum to the fluid as the flow velocity is increased from inlet to outlet.

In another aspect, a fluid flow nozzle includes a series of stages from the inlet to the outlet to sequentially increase the flow velocity without increasing turbulence or divergence of the discharge stream. Two stages have a constant diameter while three stages step down the diameter between the constant diameter stages.

In a further aspect, a selectable orifice attachment may be provided that allows the user to select among a plurality of orifice shapes and sizes. The attachment may be mounted to the discharge nozzles to further alter the discharge stream as desired by the user.

DETAILED DESCRIPTION

Figure 2B:
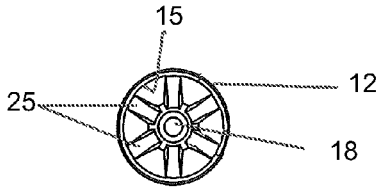
FIGS. 2(*a*)-(*d*) are engineering views of the nozzle shown in FIG. 1 including a top, outlet end, inlet end and cross-sectional views.
Figure 2D:
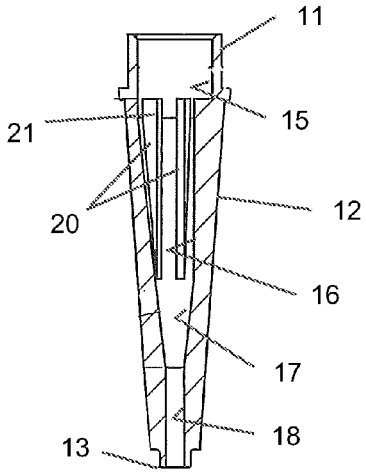
Figure 2A:
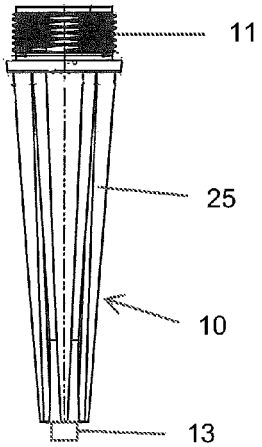

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 1:
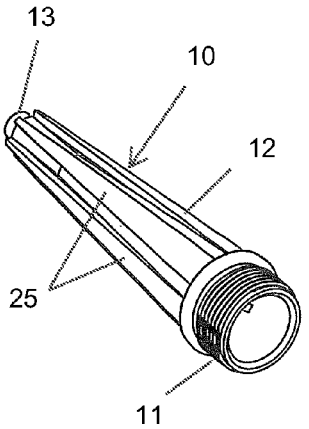
FIG. 1 is a perspective view of a fluid flow nozzle disclosed herein.
Figure 2C:
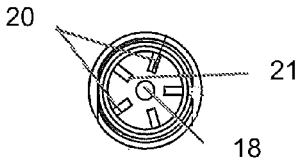

A fluid flow nozzle 10 includes an inlet end 11 that may be threaded for engagement to a garden hose, wand or other fixture, an elongated body 12 and an outlet end 13, as shown in FIG. 1 and FIGS. 2(*a*)-(*d*). The nozzle is hollow from the inlet end to the outlet end, defining an inlet channel 15, followed by a first tapered channel 16, a second tapered channel 17 and an outlet channel 18. The inlet and outlet channels 15, 18, respectively, have generally constant diameters, with the inlet having a greater diameter than the outlet. In one specific embodiment, the inlet channel may have a diameter of about 19.3 mm and the outlet channel may have a diameter of about 4.7 mm, for an approximate 4 to 1 reduction in diameter. Since the fluid flow rate is proportional to the square of the diameter, this reduction leads to an approximate 16 fold increase in flow velocity from the inlet to the outlet.

The first and second tapered channels 16, 17 are contiguous and are tapered at the same angle from the inlet channel to the outlet channel. In one specific embodiment the channels 16, 17 may be tapered at an angle of about 13.3° for a combined length of about 62.5 mm. The tapered channels thus combine to gradually reduce the flow diameter, and thereby gradually increase the flow velocity. In the specific embodiment the outlet channel may have a length of about 25 mm, or about 40% of the length of the tapered channels. The length of the tapered channels helps increase the flow velocity without turbulence, while the length of the outlet channel helps maintain a laminar flow exiting the nozzle 10. The outlet channel also helps maintain the outlet stream as narrow as possible—i.e., as close to the outlet diameter as possible. However, as with prior art nozzles, the length and diameter relationships alone are not sufficient to ensure a non-diverging outlet stream.

In order to further reduce divergence of the outlet stream, the first tapered channel 16 is provided with linear vanes 20 that extend parallel to the length of the nozzle and extend generally radially inward from the inner surface of the channel. The vanes extend from the inlet channel 15 along the length of the first tapered channel 16 and essentially have an inversely tapered height, meaning that the vanes taper from a maximum height at the inlet channel to a zero height at the junction between the first and second tapered channels. In one specific embodiment, the inner edges 21 of the vanes 20 may be defined at a diameter of about 9.9 mm. The first tapered portion with the vanes extends along about two-third (⅔) of the combined length of the two tapered portions, which in the specific embodiment provides a length of the first tapered portion of about 42.4 mm. This configuration of vanes straightens the fluid flowing through the nozzle so that the discharge stream does not diverge significantly and maintains a generally straight stream.

The body 12 of the nozzle may be tapered from the inlet to the outlet, generally parallel to the taper of the first and second tapered channels. In order to strengthen the nozzle the body 12 may be provided with outer ribs 25 running the length of the body. The nozzle may be fabricated from a suitable material, such as molded from a hard plastic material. The inlet end 11 may include external threads, as shown in FIG. 1 or may incorporate another feature for engagement to a hose, wand or similar fluid flow device. Alternatively, the entire nozzle may be integrally formed with the discharge end of a fluid flow device or may be overmolded onto the discharge end of the device.

Figure 3:
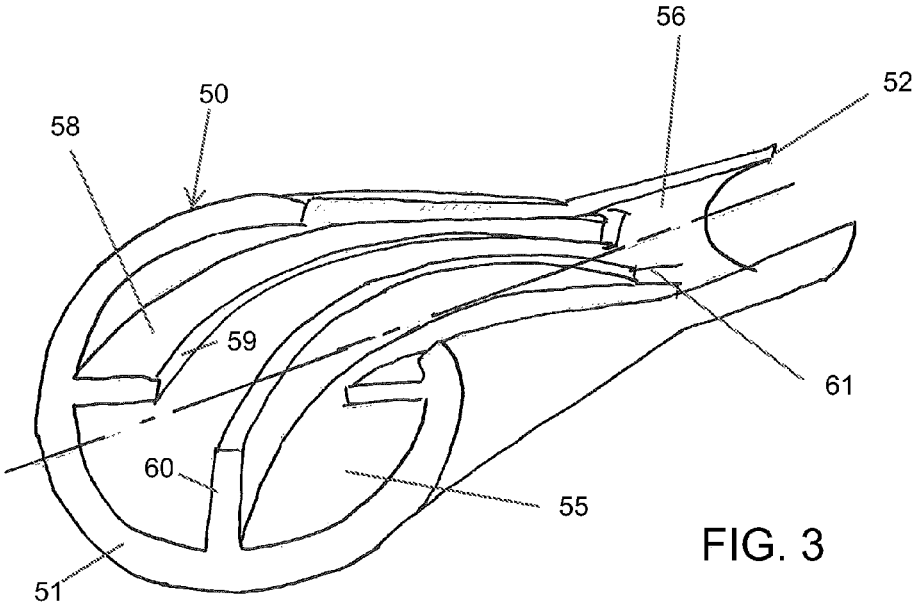
FIG. 3 is perspective partial cut-away view of a fluid flow nozzle according to another aspect of the present disclosure.
Figure 4:
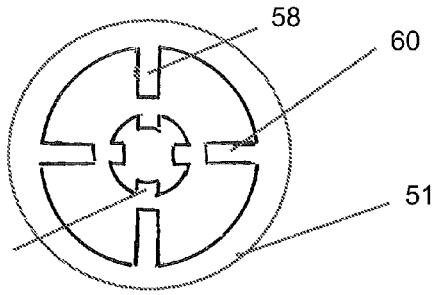
FIG. 4 is an end view of the fluid flow nozzle shown in FIG. 3.

A fluid flow nozzle 50 shown in FIGS. 3 and 4 is similar to the nozzle 10 in that the nozzle includes vanes in a tapered channel. The nozzle 50 includes an inlet end 51 and an outlet end 52. For clarity, the inlet end 51 is illustrated without any fitting for engagement to a hose, wand or other fluid flow device. However, it is understood that the nozzle 50 may incorporate a fitting or may be engaged as shown to a fluid flow device in a suitable manner. The nozzle 50 includes a tapered channel 55 extending from the inlet end 51 to an outlet channel 56 at the outlet end 52. The outlet channel may have a constant diameter while the tapered channel 55 is tapered from the larger diameter of the inlet end to the smaller diameter of the outlet end. As with the nozzle 10, the nozzle 50 may have an inlet to outlet diameter ratio of 4:1.

The nozzle 50 further includes curved vanes 58 disposed within the tapered channel 55. The height to the edge 59 of the vanes decreases from the inlet end 51 to the outlet channel 56, similar to the vanes 20 of the nozzle 10. Thus, the height at end 60 is greater than the vane height at end 61. Unlike the vanes 20, the vanes 58 do not reduce to a zero height at end 61 but instead may have a non-zero height, as depicted in FIG. 3. The vanes 58 extend along the length of the tapered channel 55 and curve in the shape of a gradual spiral from inlet to outlet end. In one example, the vanes 58 may follow a radius that is approximately equal to the length of the tapered channel 55, which in a specific example can be about 90 mm. As can be seen in FIG. 4, the ends 60 and 61 for each vane are at the same angular location in the nozzle, or in other words the outlet end 61 of the vane 58 is not angularly offset relative to the inlet end 60. In the illustrated embodiment, four vanes 58 are evenly spaced around the circumference of the tapered channel. The width of the vanes is sufficient to maintain rigidity under high flow velocities but sufficiently narrow so as not to reduce the flow area significantly.

The curvature of the vanes imparts rotational momentum to the fluid flowing through the nozzle, while the tapered channel gradually increases the flow velocity. The rotational momentum helps keep the fluid flow collimated or helps prevent the fluid stream from diverging when it exits the nozzle 50.

Figure 5:
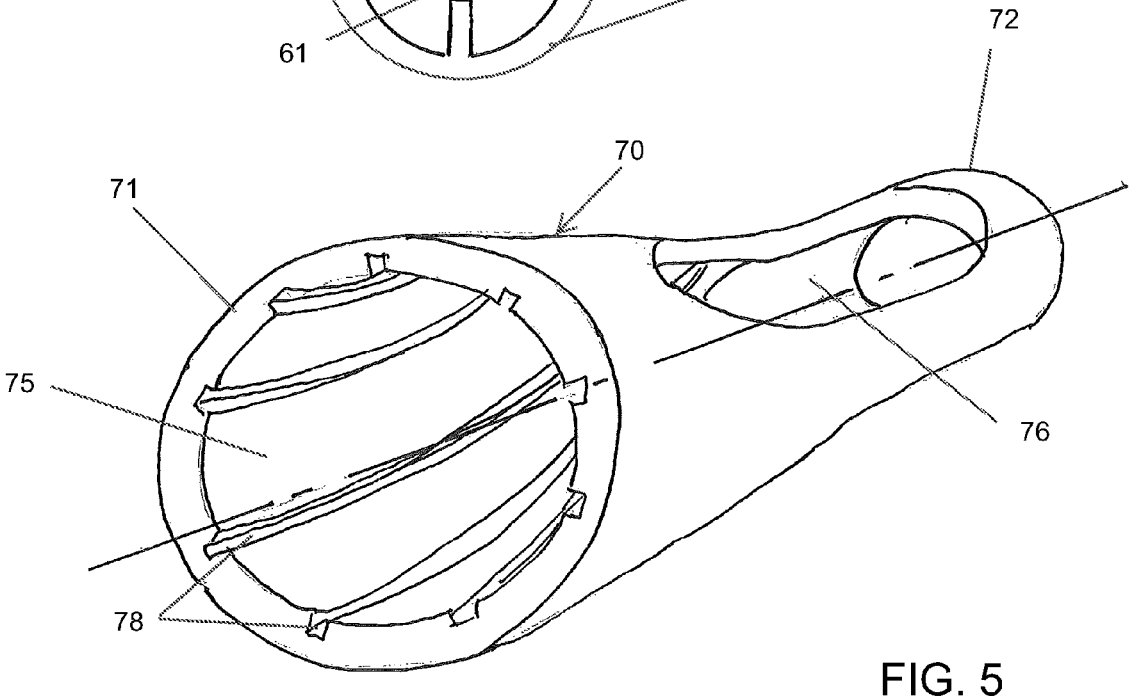
FIG. 5 is perspective partial cut-away view of a fluid flow nozzle according to a further aspect of the present disclosure.

While the nozzle 50 includes radially inwardly directed vanes, the nozzle 70 shown in FIG. 5 incorporates radially outwardly formed grooves 78 defined in the tapered channel 75 of the nozzle. The nozzle 70 includes a tapered channel 75 from the inlet end 71 to an outlet channel 76 at the outlet end 72, in a manner similar to the nozzle 50. The grooves 78 have a depth that is between one-third (⅓) and one half (½) of the wall thickness of the nozzle 70 at the tapered channel 75. The width of the channels may be between 50% and 100% of the depth. In a specific embodiment, the grooves have a width and depth of about 1.5 mm. The grooves are curved in the form of a gradual spiral. Unlike the vanes 58 of the nozzle 50, the ends of the grooves 78 may be angularly offset from each other. Since the grooves are recessed into the wall of the nozzle, the grooves do not impede the fluid flow or reduce the flow area. The grooves do impart rotational momentum to the fluid flow; however, the recessed nature of the grooves can reduce the ability to impart rotational momentum relative to the vanes of the embodiment of FIG. 3. In order to improve the ability to impart rotation to the fluid flow, a larger number of grooves 78 are provided in the nozzle 70 than vanes in the nozzle 50. At least six grooves are provided and in a specific embodiment eight grooves are uniformly spaced around the circumference of the tapered channel 75, as shown in FIG. 5.

Figure 6:
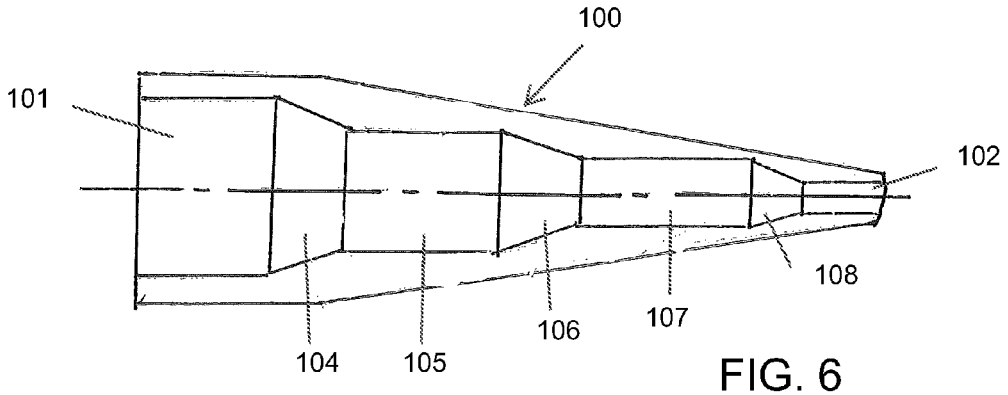
FIG. 6 is a side cross-sectional view of a fluid flow nozzle according to yet another aspect of the present disclosure.

The nozzle 100 shown in FIG. 6 includes an inlet channel 101 and an outlet channel 102 that can have a diameter ratio similar to the nozzles discussed above in order to achieve flow velocity increases of the magnitudes described herein. In order to achieve a non-turbulent linear discharge stream, the nozzle 100 incorporates staged reduction in flow area. In the illustrated embodiment, the nozzle contemplates five stages from the inlet channel to the outlet channel. The first, third and fifth stages 104, 106, 108 are tapered channels while the second and fourth stages 105, 107 are constant diameter stages. The tapered stages gradually step down the inner diameter from the diameter of the inlet channel 101 to the diameter of the outlet channel 102. In one embodiment, the diameter of the second stage channel 105 is about two-thirds (⅔) the diameter of the inlet channel, while the diameter of the fourth stage channel 107 may be about one-third (⅓) the inlet channel diameter. The tapered channels are thus configured to reduce the diameter by about one-third (⅓) at each stage.

The length of the stages may be calibrated to help reduce turbulent flow in the reducing stages 104, 106, 108 and to help maintain linear, non-turbulent flow through the constant diameter stages 105, 107. In one embodiment, the length of the constant diameter stages increases as the diameter of the stages decreases. Thus, the second stage channel 105 is longer than the inlet channel 101, and the fourth stage channel 107 is longer than the second stage channel 105. In one specific embodiment, the constant diameter stage lengths can increase by about ten percent (10%). The tapered flow area reducing stages 104, 106, 108 may all have the same length, which in a specific embodiment may be about half the length of the inlet channel 101.

Figure 7:
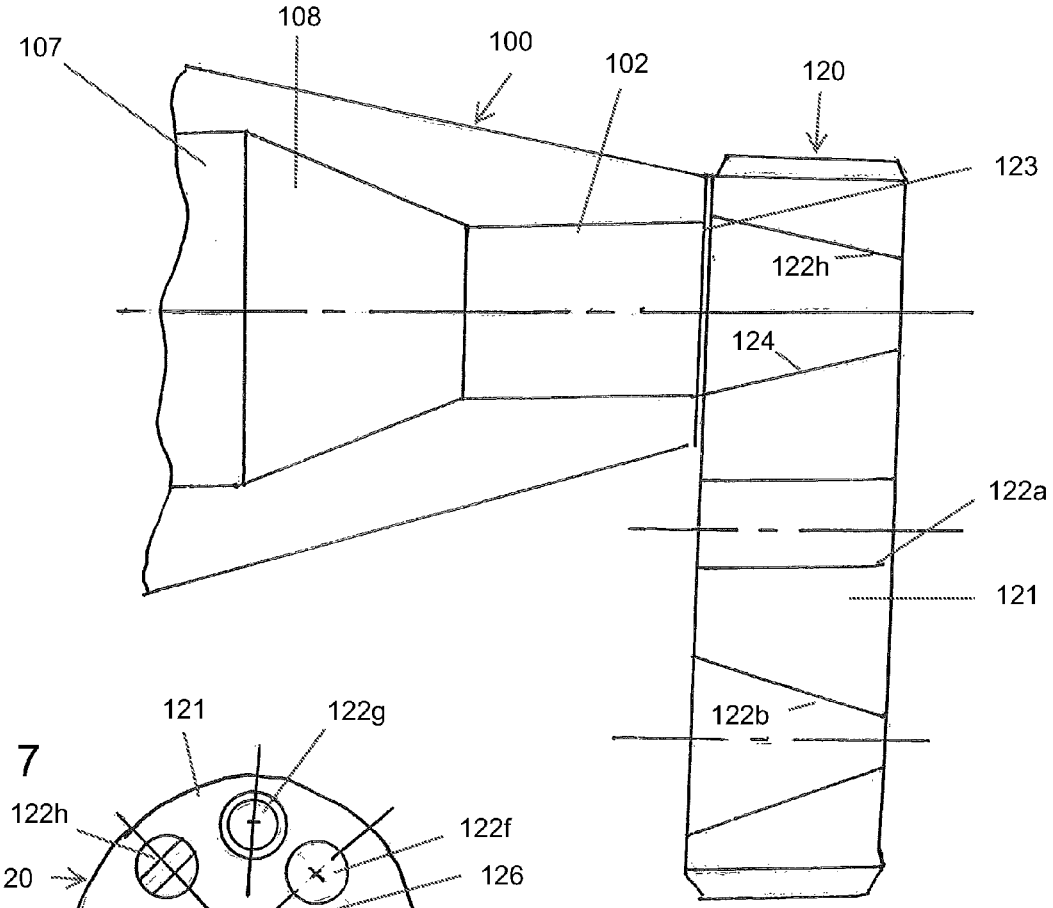
FIG. 7 is an end view of a selectable outlet opening attachment for engagement to a fluid flow nozzle in one feature of the present disclosure.
Figure 8:
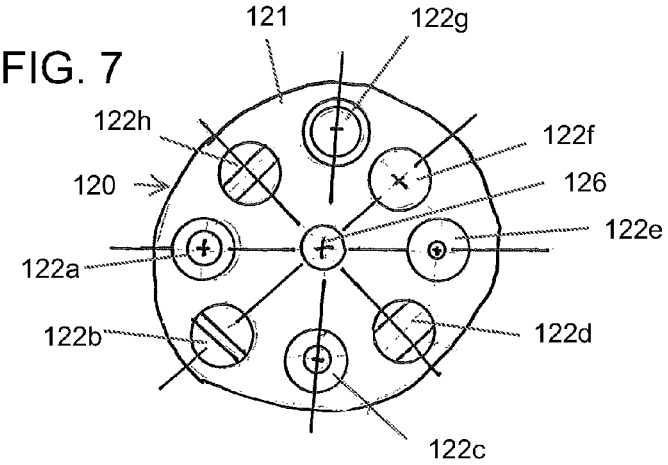
FIG. 8 is an enlarged view of the outlet end of the fluid flow nozzle shown in FIG. 6 with the selectable outlet opening attachment shown in FIG. 7 mounted thereto.

The nozzles 10, 50, 70, 100 may be provided with an attachment having selectable discharge orifices, such as the attachment 120 shown in FIG. 7 and shown engaged to the nozzle 100 in FIG. 8. The attachment includes a circular body 121 that can be mounted to a nozzle, such as nozzle 100 at a pivot point 126. A separate mounting attachment (not shown) may be provided that clamps onto the nozzle and rotatably supports the attachment 120 at the pivot point 126. The attachment includes a plurality of differently sized and shaped discharge orifices 122*a*-122*h*. Each of the orifices includes a mating face 123 that may match the shape and diameter of the outlet channel 102. The body 121 thus defines a tapered channel 124 from the mating face to the particular orifice. Some orifices may not incorporate a tapered channel, such as the orifice 122*a* that includes a constant diameter feature. The attachment 120 is configured to create a fluid-tight seal between the outlet channel, such as channel 102 of nozzle 100, and the selected orifice. Thus, the attachment may include seal rings between the nozzle and attachment, and/or the attachment may be formed of a self-sealing material, such as rubber.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A fluid flow nozzle comprising:

an elongated body having an inlet end and an outlet end, the inlet end configured for engagement to a fluid supply, the elongated body defining a channel extending therethrough from said inlet end to said outlet end;

said channel including an inlet channel adjacent said inlet end and an outlet channel adjacent said outlet end, said inlet channel defined at an inlet diameter and said outlet channel defined at an outlet diameter that is less than said inlet diameter;

said channel further defining a tapered channel extending from said inlet channel to said outlet channel and having a length between said inlet and outlet channels; and said elongated body further defining a plurality of vanes circumferentially spaced around said tapered channel in a substantially spiral shape to impart a rotational momentum on fluid flowing through the channel, said plurality of vanes extending along at least a portion of the length of said tapered channel.

2. The fluid flow nozzle of claim 1, wherein said tapered channel includes a first tapered channel adjacent said inlet channel and a second tapered channel adjacent said outlet channel, said plurality of vanes defined only in said first tapered channel.

3. The fluid flow nozzle of claim 2, wherein said first and second tapered channel are defined at the same taper angle.

4. The fluid flow nozzle of claim 3, wherein said taper angle is about thirteen degrees (13°).

5. The fluid flow nozzle of claim 2, wherein said plurality of vanes are tapered from a maximum height adjacent said inlet channel to substantially zero height adjacent said second tapered channel.

6. The fluid flow nozzle of claim 1, wherein said inlet channel has a substantially constant diameter equal to said inlet diameter and said outlet channel has a substantially constant diameter equal to said outlet diameter.

7. The fluid flow nozzle of claim 6, wherein said inlet diameter is about four (4) times greater than said outlet diameter.

8. The fluid flow nozzle of claim 6, wherein said outlet channel has a length from said second tapered channel to said outlet end that is about forty percent (40%) of the length of said tapered channel.

9. The fluid flow nozzle of claim 1, wherein the outer surface of said elongated body is tapered from said inlet end to said outlet end and said body further defines strengthening ribs extending along said outer surface form said inlet end to said outlet end.

10. The fluid flow nozzle of claim 1, wherein said plurality of vanes extend along said tapered channel from said inlet end to said outlet end.

11. The fluid flow nozzle of claim 10, wherein said plurality of vanes have an first end adjacent said inlet end of said nozzle and a second end adjacent said outlet end of said nozzle, said first end and said second arranged at substantially the same angular position around the circumference of said tapered channel.

12. The fluid flow nozzle of claim 10, wherein said outlet channel has a length from said tapered channel to said outlet end that is about forty percent (40%) of the length of said tapered channel with a substantially constant diameter equal to said outlet diameter.

13. The fluid flow nozzle of claim 1, wherein said plurality of vanes includes four (4) vanes.

14. A fluid flow nozzle comprising:

an elongated body having an inlet end and an outlet end, the inlet end configured for engagement to a fluid supply, the elongated body defining a channel extending therethrough from said inlet end to said outlet end;

said channel including an inlet channel adjacent said inlet end and an outlet channel adjacent said outlet end, said inlet channel defined at an inlet diameter and said outlet channel defined at an outlet diameter that is less than said inlet diameter;

said channel further defining a tapered channel extending from said inlet channel to said outlet channel and having a length between said inlet and outlet channels; and said elongated body further defining a plurality of grooves circumferentially spaced around said tapered channel portion in a substantially spiral shape to impart a rotational momentum on fluid flowing through the channel, said plurality of grooves extending along at least a portion of the length of said tapered channel.

15. The fluid flow nozzle of claim 14, wherein said plurality of grooves includes at least six (6) grooves.

16. The fluid flow nozzle of claim 14, wherein said plurality of grooves extend along said tapered channel from said inlet end to said outlet end.

17. The fluid flow nozzle of claim 16, wherein said plurality of grooves have an first end adjacent said inlet end of said nozzle and a second end adjacent said outlet end of said nozzle, said first end and said second arranged at different angular positions around the circumference of said tapered channel.

18. The fluid flow nozzle of claim 1, further comprising an attachment adapted to be mounted to said elongated body, said attachment including:

a plurality of orifices having differently configured discharge configurations; and a mating face at each orifice adapted to be selectively aligned with said outlet channel, each orifice having a diameter at said mating face that is substantially equal to said outlet diameter.

19. The fluid flow nozzle of claim 2, wherein said first tapered channel extends along about two-thirds (⅔) of the length of said tapered channel.

* * * * *